United States Patent [19]

Hill

[11] 4,323,944

[45] Apr. 6, 1982

[54] CONTROL CIRCUIT FOR AN ELECTROMAGNET

[75] Inventor: William F. Hill, Stafford, England

[73] Assignee: Lucas Industries Limited, Birmingham, England

[21] Appl. No.: 196,430

[22] Filed: Oct. 14, 1980

[30] Foreign Application Priority Data

Oct. 25, 1979 [GB] United Kingdom ..... 36990/79

[51] Int. Cl.[3] ..... H01H 47/32

[52] U.S. Cl. ..... 361/152; 361/156

[58] Field of Search ..... 361/139, 143, 152, 154, 361/155, 156, 159, 160

[56] References Cited

U.S. PATENT DOCUMENTS 3,467,894 9/1969 Blume ..... 361/156

4,223,367 9/1980 Zappala ..... 361/156

*Primary Examiner*—Harry E. Moose, Jr.

*Attorney, Agent, or Firm*—Ladas & Parry

[57] ABSTRACT

A control circuit for an electromagnet includes a high voltage converter with a main energy storage element on which is stored a voltage higher than the supply voltage. A switch element connects this main storage element to the electromagnet and to an inductor by way of which energy is transferred to a secondary energy storage element which is used at the end of the electromagnet energization period to cause rapid collapse of the electromagnet flux.

11 Claims, 6 Drawing Figures

FIG.3.
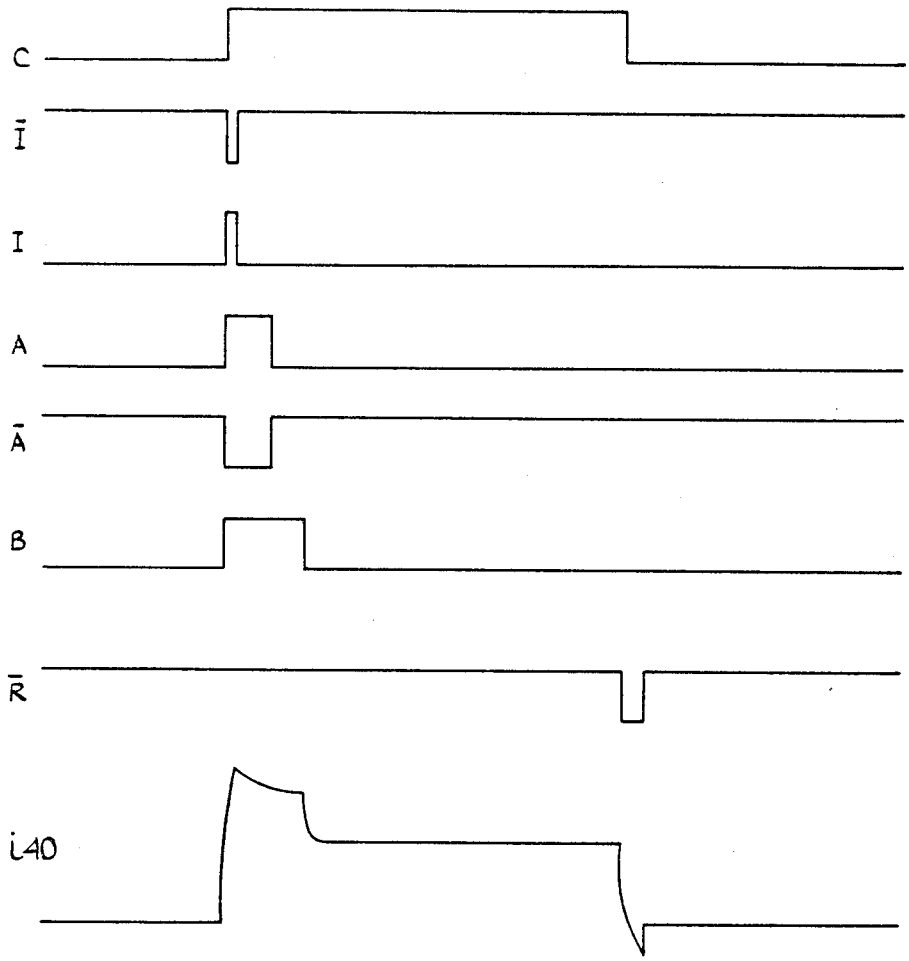
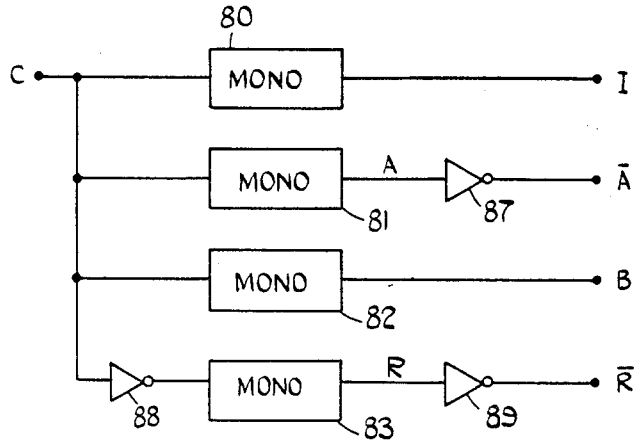
FIG.2.

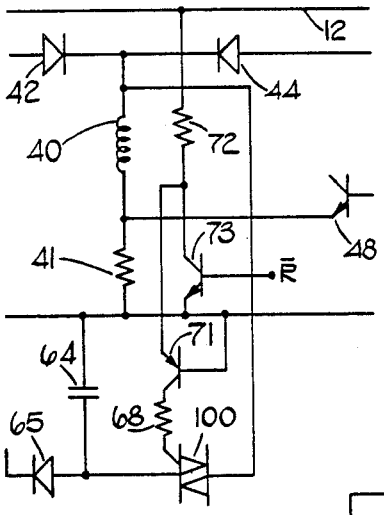
FIG.4.
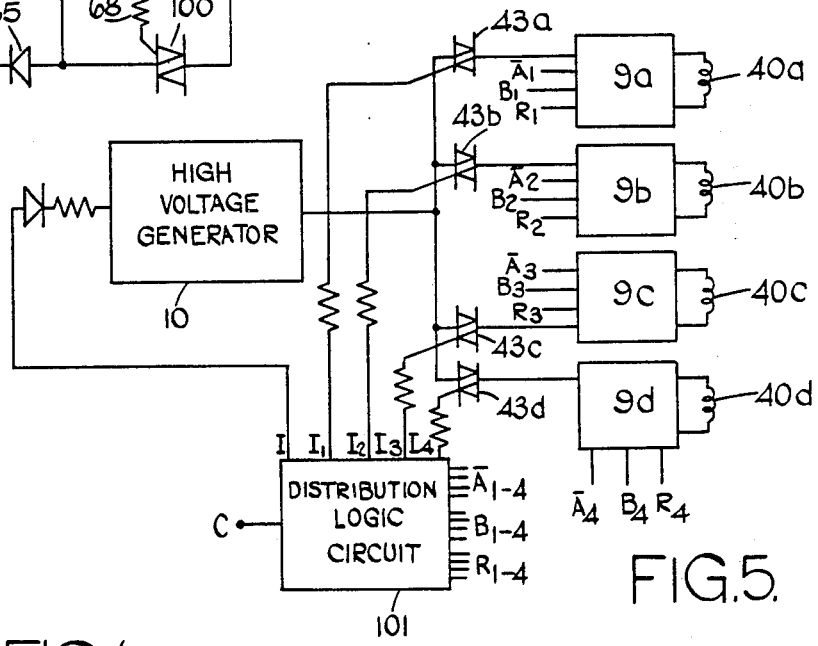
FIG.5.
FIG.6.
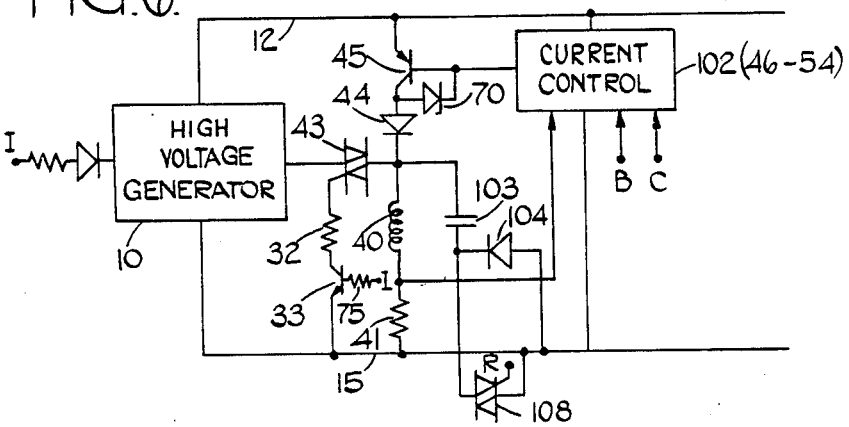

CONTROL CIRCUIT FOR AN ELECTROMAGNET

This invention relates to a control circuit for an electromagnet.

It is frequently required to provide an electromagnet control circuit which enables the flux in the electromagnet to be forced to build up quickly and also to collapse quickly in spite of eddy currents in the electromagnet core. Such a requirement exists, for example, in solenoid valves for road vehicle fuel injection systems where the fuel flow is controlled by a pulse-duration modulation circuit. Such rapid flux build up can be obtained by connecting the winding briefly to a high voltage supply and collapse can similarly be hastened by connecting the winding briefly to a reverse polarity high voltage supply.

When such forcing and collapse arrangements are to be used in a low voltage system, such as in a road vehicle, the high voltages required can be generated utilizing some form of converter. Problems may then arise in ensuring that there is an adequate interval between operations of the electromagnet to ensure sufficient energy storage in the converter.

It is an object of the present invention to provide a control circuit in which these problems are avoided.

A control circuit in accordance with the invention comprises a converter circuit including a main energy storage element, a secondary energy storage element and circuit means connecting the main energy storage element to the electromagnet and to the secondary energy storage element and operating to cause energy to be transferred from main energy storage element to the electromagnet, and also effecting transfer of energy from the main energy storage element to the secondary storage element for subsequent use in applying a reverse voltage to the electromagnet when the period of energisation thereof is terminated.

In the accompanying drawings,

FIG. 2 is a block diagram of a timing circuit associated with the circuit of FIG. 1, FIG. 3 is a graph showing the outputs of the FIG. 2 circuit, FIG. 4 is a circuit diagram showing a modification to FIG. 1, FIG. 5 is a block diagram of another example of the invention and FIG. 6 is the circuit diagram of a further embodiment.

Figure 1:
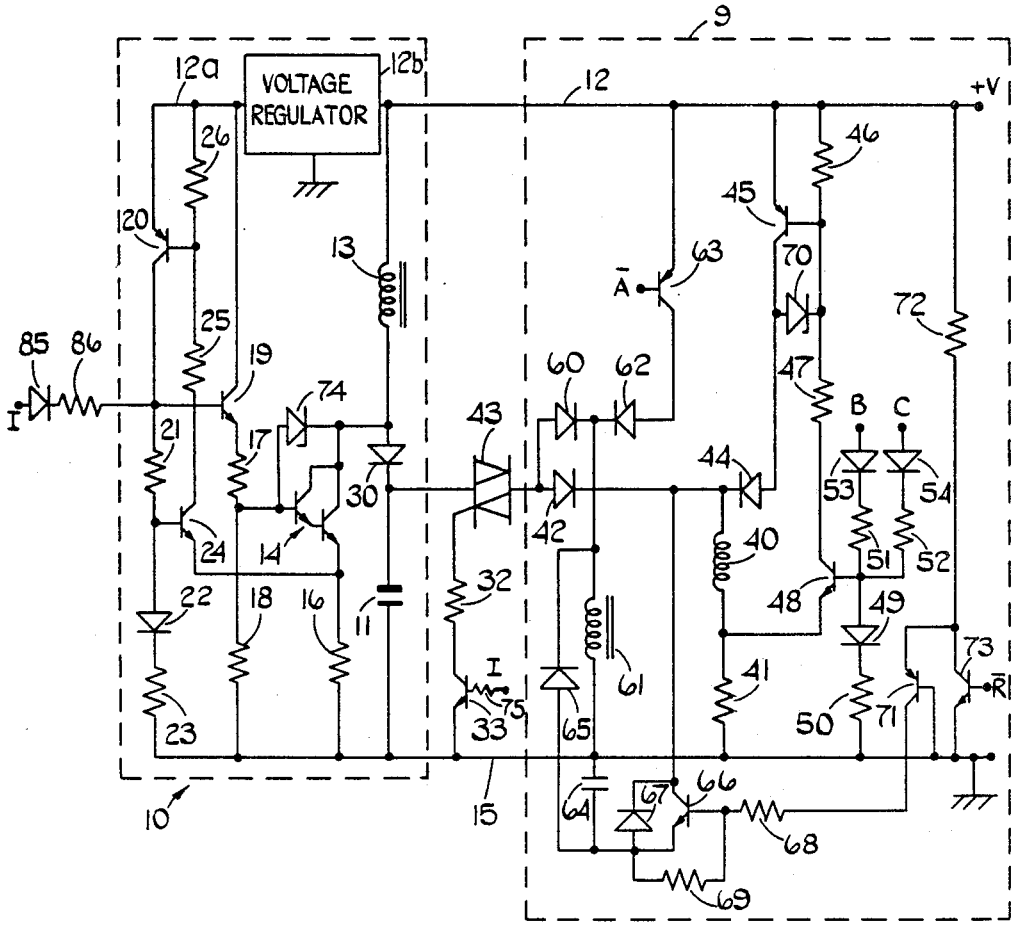
FIG. 1 is a circuit diagram of an example of the invention.

Referring firstly to FIG. 1 the circuit shown includes a power converter 10 for producing a relatively high voltage on a capacitor 11 from a relatively low voltage power supply rail 12 connected, for example, to a road vehicle battery. The converter 10 includes an inductor 13 connected between the rail 12 and the collector of a Darlington transistor 14. The emitter of transistor 14 is connected to an earth rail 15 by a current sensing resistor 16.

The base of the transistor 14 is connected to the junction of two resistors 17, 18 which are connected in series between the emitter of an npn transistor 19 and a rail 15. The collector of the transistor 19 is connected to the rail 12*a* which is coupled to rail 12 by a 5 volt voltage regulator 12*b*, and its base is connected to the collector of a pnp transistor 20 which has its emitter connected to rail 12*a*. The collector of the transistor 20 is connected by a resistor 21 to the anode of a diode 22, the cathode of which is connected by a resistor 23 to the rail 15. An npn transistor 24 has its base connected to the anode of the diode 22 and its emitter connected to the emitter of transistor 14. The collector of transistor 24 is connected by two resistors 25, 26 in series to the rail 12*a*, the junction of these resistors being connected to the base of the transistor 20.

A diode 30 has its anode connected to the collector of the transistor 14 and its cathode connected to one terminal of the capacitor 11, the other terminal of which is connected to the rail 15.

The electromagnet winding 40 to be controlled by the circuit described herein is connected at one end by a resistor 41 to the rail 15. The other end of winding 40 is connected to the cathode of a diode 42 the anode of which is connected by a triac 43 to said one terminal of the capacitor 11 so that when the triac 43 is fired the high voltage stored on the capacitor 11 is applied to the winding 40. The triac has its gate connected by a resistor 32 to the collector of an npn transistor 33, the emitter of which is connected to rail 15, so that the triac is fired by turning on transistor 33. A further diode 44 has its cathode connected to said other end of the winding. The anode of the diode 44 is connected to the collector of a pnp transistor 45, the emitter of which is connected to the rail 12. The base of the transistor 45 is connected to the junction of two resistors 46, 47 in series between the rail 12 and the collector of an npn transistor 48. A zener diode 70 has its cathode connected to the base of transistor 45 and its anode connected to the collector of that transistor. The emitter of the transistor 48 is connected to said one end of the winding 40. The base of the transistor is connected to the anode of a diode 49, the cathode of which is connected to the rail 15 by a resistor 50. The base of transistor 48 is also connected by two resistors 51 and 52 to the cathodes of two respective diodes 53 and 54, having their anodes connected to two input terminals B and C respectively.

A diode 60 has its anode connected to the anode of the diode 42 and its cathode connected to one end of an inductor 61, the other end of which is connected to the rail 15. A further diode 62 has its cathode connected to the cathode of the diode 60 and its anode connected to the collector of a pnp transistor 63, the emitter of which is connected to the rail 12 and the base of which is connected to a terminal $\overline{A}$. A zener diode 74 has its cathode connected to the collectors of transistors 14 and its anode connected to the base thereof.

A secondary energy storage element in the form of a capacitor 64 is connected at one side to the rail 15 and at the other side to the anode of a diode 65, the cathode of which is connected to the cathodes of diodes 60, 62. An npn transistor 66 has its emitter connected to the anode of the diode 65 and its collector connected to said other end of the winding 40. A diode 67 has its anode connected to the emitter of the transistor 66 and its cathode connected to the collector thereof. The base of the transistor 66 is connected to the junction of two resistors 68, 69 which are connected in series between the collector of a pnp transistor 71 and the emitter of the transistor 66. The base of transistor 71 is connected to the rail 15 and its emitter is connected by a resistor 72 to the rail 12. An npn transistor 73 has its emitter connected to rail 15, its collector connected to the emitter of transistor 71 and its base connected to a terminal $\overline{R}$.

Turning now to FIG. 2 the circuit shown in block form therein includes four monostable circuits 80, 81, 82 and 83. The monostable circuits 80, 81 and 82 receive inputs from the terminal C which is connected to a further control circuit (not shown) which causes the signal at terminal C to be high only when it is required for the electromagnet to be energised. Of these three monostable circuits, the circuit 80 has the shortest reversion time and is used to generate a signal $\overline{I}$ which is applied to the base of the transistor 33 via a resistor 75 and is applied via a diode 85 and a resistor 86 in series (FIG. 1) to the base of the transistor 19. The circuit 81 produces a signal A which persists somewhat longer than the I signal and is connected via a logic inverter 87 to the base of transistor 63 (FIG. 1). Circuit 82 produces a longer signal B long enough for the load operated by the electromagnet 40 (for example a valve element in a solenoid valve) to be pulled in. Circuit 83 is connected to terminal C via a logic inverter 88 so that it is triggered when the signal at terminal C goes low and produces a brief pulse which is applied via an inverter 89 to the terminal R.

When the I signal goes high transistors 19 and 24 turn on. Conduction of transistor 24 causes transistor 20 to turn on thereby latching transistor 24 on. The transistor 14 is also turned on thereby causing current to start building up in inductor 13. The voltage across resistor 16 rises as the current in the inductor 13 rises (the current in resistor 16 being almost equal to that in the inductor 13) until this voltage becomes equal to that across the resistor 23 whereupon transistors 24 and 20 rapidly turn off so that transistors 19 and 14 also turn off. This sudden interruption in the current path through the inductor 13 causes the voltage at collector of transistor 14 to rise rapidly so that, via diode 30, the capacitor 11 receives energy stored in the inductor 13 at switch off and is charged to a high voltage.

The I signal also turns on the triac 43 via the transistor 33, and the capacitor 11 discharges through diode 42 into the winding 40 and through diode 60 into the inductor 61. At this time the signal $\overline{A}$ is low so that transistor 63 is saturated, and signals B and C are both high, the values of resistors 41, 50 and 51 being such that the current in resistor 41 is not high enough to turn off transistor 48 so that transistor 45 is also saturated. Thus when the voltage on the capacitor 11 falls to less than the voltage on rail 12 the triac 43 turns off. In practice, this takes about 0.25 mS and this process is completed before transistor 14 turns off to recharge capacitor 11 in preparation for the next cycle. Current in the inductor 61 is maintained via transistor 63 until the $\overline{A}$ signal goes high whereupon transistor 63 turns off and the energy stored in inductor 61 is transferred to the capacitor 64, charging this up negatively via the diode 65. Meanwhile the initial high level forcing current in the winding 40 has decayed somewhat even though transistor 45 remains saturated, but when the B signal goes low, the voltage across resistor 50 becomes less than that across resistor 41 and transistors 48 and 45 turn off. The diode 67 now acts to permit energy from the winding 40 to be transferred to the capacitor 64, and when the voltage on the latter is sufficiently high zener diode 70 conducts enabling remaining energy from winding 40 to be dissipated in transistor 45 until the current in winding 40 falls to a level such that the voltages across resistors 41 and 50 are equal whereafter transistors 48 act to maintain the current at this level until the C signal goes low. At this stage the transistors 48 and 45 turn off, but the $\overline{R}$ signal biases transistor 66 on via transistors 71 and 73. The reverse voltage on capacitor 64 is now connected to the winding 40 for either polarity of the current causing very rapid decay and reversal of the current therein. When the $\overline{R}$ signal goes high the current in the winding 40 will have reversed and a positive going transient will be produced. This transient is absorbed by the diode 67 acting as a zener diode.

In the modification of the above circuit shown in FIG. 4 the transistor 66 is replaced by a triac 100 fired by the $\overline{R}$ signal. In this case the capacitor 64 will be fully discharged at the end of each cycle, but the circuit (not shown) which controls the frequency and duration of the C pulses, must be such that a condition cannot arise in which both triacs are conducting simultaneously.

It will be appreciated that although the secondary energy storage element in the above described is a capacitor, an inductor could be used for this purpose. Co-pending U.S. application No. 187,882 filed Sept. 17, 1980 discloses a circuit in which an inductor is used and the present invention could be applied to that circuit by substituting the converter 10 and the triac 43 of the example described above for the H. T. rail 27 and the transistor 26 of the circuit described in U.S. application No. 187,882.

The main energy storage element could, in alternative embodiments (not shown) be an inductor from which energy is transferred directly to the electromagnet and the secondary storage element.

Turning now to FIG. 5, there is illustrated an embodiment of the invention in which there are several electromagnets 40*a*, 40*b*, 40*c* and 40*d* to be energised in a fixed sequence by successive C pulses from a frequency and duration control (not shown). The high voltage generator 10 is the same as that shown in FIG. 1 and there is only one of these for all the electromagnets. Each electromagnet 40*a* to 40*d* has its own associated control circuit 9*a* to 9*d* which are each the same as the circuit 9 in FIG. 1. Each circuit 9*a* to 9*d* is connected to the output of the generator 10 by a separate triac 43*a*. 43*b*, 43*c* and 43*d*, and the firing of these is controlled by a distribution logic circuit 101 which also controls the signals to the $\overline{A}$, B and $\overline{R}$ terminals of the individual circuits 9*a* to 9*d*. The details of the logic circuit 101 need not be given herein. Suffice it to say that the circuit 101 includes all the elements of the circuit of FIG. 3 with gates controlled by a ring counter to determine to which triac 43*a* to 43*d* and which circuits 9*a* to 9*d* the outputs of the FIG. 3 circuit are routed.

Turning finally to FIG. 6, the alternative embodiment shown therein again includes the same high voltage generator 10 as that used in FIG. 1. The electromagnet 40 is connected in series with a current sensing resistor 41, a diode 44 and the collector-emitter of a pnp transistor 45 exactly as in FIG. 1 and the transistor 45 is controlled by components 46 to 54 (here denoted by box 102). The triac 43, controlled by resistor 32 and transistor 33, connects the output of the high voltage generator 10 to the electromagnet 40.

The secondary storage device in this case is a capacitor 103 one side of which is connected to the upper end of the electromagnet 40 as viewed in FIG. 6. The other side of the capacitor 103 is connected by two separate circuit paths to the rail 15. One such path includes a diode 104 with its anode connected to the rail 15. The other path consists of a triac 108 with its gate terminal connected to the R terminal (the circuit of FIG. 2 being modified by the omission of inverter 89 so that the R pulse is positive-going).

With this arrangement firing of triac 43 at the beginning of a C pulse causes current to build up very rapidly in the electromagnet 40, but at this time both the diode 104 and the triac 108 are non-conducting so that capacitor 103 does not receive any charge. At the end of the B pulse, at the time of the change from pull-in current to holding current diode 104 conducts briefly as the current in the electromagnet 40 is falling. As a result capacitor 103 becomes charged up with its lower side more positive than its upper side (as viewed in FIG. 6). Finally, at the end of the C pulse, the triac 108 is triggered so that the capacitor 103 is again connected across the electromagnet and the reverse charge on the capacitor 103 causes the current in the electromagnet to be reduced very rapidly to zero, at which point the triac 108 turns off automatically.

I claim:

1. A control circuit for an electromagnet comprising a converter circuit including a main energy storage element, a secondary energy storage element, and circuit means connecting the main storage element to the electromagnet and to the secondary energy storage element and operating to cause energy to be transferred from main energy storage element to the electromagnet, and also effecting transfer of energy from the main energy storage element to the secondary storage element for subsequent use in applying a reverse voltage to the electromagnet when the period of energisation thereof is terminated.

2. A control circuit as claimed in claim 1 in which said circuit means comprises first and second independent circuit paths connecting the main storage element directly to the electromagnet and the secondary storage element respectively and a further circuit path for connecting the secondary storage element to the electromagnet at termination of energisation of the latter.

3. A control circuit as claimed in claim 2 in which said first and second independent circuit paths include a common semi-conductor switch element.

4. A control circuit as claimed in claim 3 in which said first path also includes a diode connecting said switch element to the electromagnet.

5. A control circuit as claimed in claim 2 in which said secondary storage element is a capacitor, said second circuit path including an inductor into which energy from the main storage element is transferred, means for maintaining current flow in the inductor and for interrupting such current flow, and diode means connecting the inductor to the capacitor so that on interruption of the current flow in the inductor, the energy stored therein is transferred to the capacitor.

6. A control circuit as claimed in claim 5 in which said further circuit path comprise a semi-conductor switch element for connecting the capacitor in parallel with the electromagnet.

7. A control circuit as claimed in claim 1 further comprising current control means for maintaining current flow in the electromagnet following the transfer thereto of energy from the main energy storage element.

8. A control circuit as claimed in claim 7 in which said current control means operates initially to maintain current in the electromagnet at a relatively high level and subsequently acts as a current regulator, which maintains the electromagnet current at a significantly lower level.

9. A control circuit as claimed in claim 8 in which said circuit means comprises a semi-conductor switch element connecting the main storage element to the electromagnet, a controlled current path connecting the electromagnet to the secondary storage element and active during reduction of the current level from its initial high level to its subsequent lower level to transfer energy already transferred from the main storage element to the electromagnet to the secondary energy storage element and a further controlled current path connecting the secondary storage element to the electromagnet and active only at the termination of energisation of the electromagnet.

10. A control circuit as claimed in claim 9 in which the secondary storage element is a capacitor.

11. A control circuit as claimed in claim 1 for controlling a plurality of electromagnets, comprising a common converter circuit, a plurality of secondary energy storage elements a plurality of said circuit means connecting the common converter to respective ones of the electromagnets and to respective ones of the secondary energy storage means and a distribution logic circuit controlling said plurality of said circuit means whereby the electromagnets are energised in a predetermined sequence.

* * * * *